144-242 Sa
10/15/85 XR 4,546,572

United States Patent [19]

Fischer

[11] Patent Number: 4,546,572

[45] Date of Patent: Oct. 15, 1985

[54] BELT GRINDING MACHINE

[75] Inventor: Kurt Fischer, Bad Münder, Fed. Rep. of Germany

[73] Assignee: Bison-Werke Bahre & Greten GmbH & Co. KG, Springe, Fed. Rep. of Germany

[21] Appl. No.: 603,727

[22] Filed: Apr. 25, 1984

[30] Foreign Application Priority Data

May 3, 1983 [DE] Fed. Rep. of Germany ..... 3316154

[51] Int. Cl.[4] ..... B24B 21/04

[52] U.S. Cl. ..... 51/140; 51/137; 51/80 A; 144/242 R

[58] Field of Search ..... 51/80 A, 87 R, 135 R, 51/137, 138, 139, 140, 165 R, 165.8, 165.85, 165.9, 165.91, 165.74, 165.75, 165.92; 144/242 R

[56] References Cited

U.S. PATENT DOCUMENTS

| | | | |
|---|---|---|---|
| 2,463,750 | 3/1949 | Curtin | 51/165.75 X |
| 2,895,263 | 7/1959 | Reynolds | 51/139 |
| 3,169,352 | 2/1965 | Smith | 51/140 |
| 3,269,065 | 8/1966 | Nylund | 51/326 X |
| 3,859,760 | 1/1975 | Grieb et al. | 51/165.75 |
| 3,895,464 | 7/1975 | Kiser | 51/140 X |
| 3,939,611 | 2/1976 | Hesler et al. | 51/139 |
| 3,991,522 | 11/1976 | Hedlund | 51/138 X |
| 4,178,721 | 12/1979 | Evans | 51/140 X |
| 4,248,019 | 2/1981 | Hawley et al. | 51/165.92 X |
| 4,322,919 | 4/1982 | Gerber | 51/139 |

*Primary Examiner*—Robert P. Olszewski

[57] ABSTRACT

A belt grinding machine is described for the grinding of chipboard, fibreboard, faced board for similar boards in which the upper part of the housing can be raised and lowered relative to the lower part of the housing by a lifting device for adaptation to different board thicknesses. Spaced apart distance pieces or spacers are provided between the two parts of the housing to enable the basic board thickness to be selected. In order to ensure that boards of widely varying thicknesses can be machined with a grinding accuracy which meets the highest requirements, even when the boards that are supplied have relatively large thickness variations, a vertically steplessly adjustable clamping element, which is acted on by a pressure fluid, is associated with each spacer. In the lowered state of the upper part of the housing the clamping device clamps the upper part to the lower part with the spacers being trapped therebetween. The pressure of the pressure fluid supplied to the clamping devices is adjustable.

18 Claims, 2 Drawing Figures

BELT GRINDING MACHINE

The invention relates to a belt grinding machine for the surface grinding of board having upper and lower surfaces and has particular reference to a belt grinding machine for the grinding of particleboard such as chipboard, fibreboard, or faced boards, or of plywood. A belt grinding machine of this kind is known from German patent No. 16 77 135. The known machine has first and second longitudinal sides and comprises an upper housing part, a lower housing part and means for feeding the board between the upper and lower housing parts. Hydraulic lifting means are provided for lifting the upper housing part relative to the lower housing part for adaptation to different board thicknesses. Respective spacers are provided at each of the first and second longitudinal sides between the upper housing part and the lower housing part for effecting a basic board thickness selection. At least one belt grinding unit is accommodated in at least one of the upper and lower housing parts and has an endless grinding belt and guide means for guiding the endless belt over one of the surfaces of the board. Support means are disposed opposite to the guide means and engage with the other side of the board.

In the known machine the support means comprises a counterpressure roller and a source of stored energy constantly presses the counter-pressure roller towards the guide means and thus towards the grinding belt. This arrangement is intended to prevent oscillations of the belt grinding unit leading to a change in the width of the grinding gap. It ensures that irregularities in the surface machining are avoided, even with vertical oscillations of the grinding belt, and that a constant and accurate working depth is obtained even when such oscillations occur.

Another belt grinding machine is known from German patent No. 30 41 377. This known machine also has at least one belt grinding unit in which the grinding belt is guided around a contact roller. A counter pressure roller is provided opposite to the contact roller on the opposite side of the workpiece and presses the workpiece towards the contact roller. At least one support roller is associated with the counter-pressure roller on the side remote from the contact roller and can be pressed against the counter-pressure roller by means of a piston- in-cylinder unit. In this way it is ensured that the height of the working gap between the contact roller and the counter-pressure roller remains constant over the entire width of the machine, even under the changing load conditions which arise in practice, because an additional and variable pressure can be exerted on specific regions of the counter-pressure element.

The principal object underlying the present invention is to further develop a belt grinding machine of the initially named kind in such a way that with both heavy-,and also intermediate and light frame constructions it is possible to machine boards of widely differing thicknesses, and with an accuracy which satisfies the highest requirements, even when the boards that are supplied exhibit relatively large thickness variations.

SUMMARY OF THE INVENTION

In order to satisfy this object there is provided, in accordance with the present invention, a belt grinding machine for the surface grinding of board having upper and lower surfaces, in particular of particleboard such as chipboard, fibreboard, or faced boards, or of plywood, the machine having first and second longitudinal sides and comprising an upper housing part; a lower housing part; means for feeding the board between said upper housing part and said lower housing part; hydraulic lifting means for lifting said upper housing part relative to said lower housing part for adaptation to different board thicknesses; respective spacers provided at each of said first and second longitudinal sides between said upper housing part and said lower housing part for effecting a basic board thickness selection; at least one belt grinding unit accommodated in at least one of said upper and lower housing parts; said at least one belt grinding unit having a respective endless grinding belt and guide means in the form of one of at least one of a contact roller and a pressure beam for guiding said endless belt over one of said upper and lower surfaces; and support means disposed opposite to said guide means and engageable with the other one of said upper and lower surfaces; wherein a respective pressure fluid loaded and vertically steplessly adjustable clamping device is associated with each of said spacers for clamping said upper housing part to said lower housing part.

As a result of this arrangement a force-locked connection is provided between the upper housing part and the lower housing part, for all the required gap widths, due to the cooperation of the spacers and the clamping devices(or load elements)which are acted on by a pressure fluid. This form-locked connection ensures that the grinding gap, once selected, is constant and accurate over the length of the machine, and that it can be rapidly and simply adjusted to new values with appropriate accuracy.

The support means can conveniently comprise either a second belt grinding unit or a counter-pressure roller.

In a preferred arrangement four of the belt grinding units are provided, with two of the belt grinding units being disposed in the upper housing part for grinding the upper surface of the board and with the further two belt grinding units being disposed in said lower housing part for grinding said lower surface of the board.

At least some of the clamping devices are preferably constructed in the form of double-acting piston-in-cylinder units. In this way the clamping devices can take on a double function in as much as they can both fulfil their actual function, namely the axial clamping of the spacers between the upper and lower parts of the housing, and can also be used to lift the upper part of the housing relative to the lower part of the housing in order to open the belt grinding machine and to make it possible to select the particular grinding gap that it desired.

It is particularly advantageous if the spacers are steplessly adjustable because it is then possible, as a result of the cooperation of these steplessly adjustable spacers with the pressure fluid loaded clamping devices to adjust the grinding gap which is required in any one case so accurately that the fine adjustment devices for the contact rollers necessary in customary belt grinding machines are no longer required.

The clamping devices and the associated spacers are advantageously arranged directly adjacent one another and so distributed over the length of the belt grinding machine that a deformation-free clamping of the housing upper part to the housing lower part is ensured.

In accordance with an advantageous development of the invention each spacer preferably comprises a threaded spindle and an associated fixed abutment, with the spindle, which can in particular be actuated either by hand or by a positioning motor, engaging in a threaded block provided on one part of the housing and engaging in a support sleeve secured to the other part of the housing.

In order to always achieve an exact and uniform adjustment of the spacers these spacers are expediently coupled together by an actuating mechanism and are jointly adjustable.

A position transducer which always provides accurate information concerning the width of the grinding gap predetermined by the spacers is usefully associated with at least one of the spacers.

In one variant of the invention, which is of particular advantage, a fluid pressure system having pressure limiting means is connected to said clamping devices. By using a pressure limiting device of this kind, which can for example consist of at least one excess pressure valve, it is ensured that the pressure limiting means will respond to a deviation in thickness with is too great in relation to the preset desired thickness of the particular board, and will suddenly reduce the clamping pressure on the clamping devices, so that sources of danger for the belt grinding units are overcome in this way.

In accordance with a further advantageous development of the invention the spacers and clamping devices are constructed as an integral unit, with preferably the steplessly adjustable part of the spacer consisting of a support sleeve which is screwed to the cylinder of the piston-in-cylinder unit, and with the support sleeve cooperating with a fixed abutment which surrounds the piston of the piston-in-cylinder unit and is located at the part of the housing opposite to the cylinder of the piston-in-cylinder unit.

This compact construction simplifies the assembly and makes it easier to arrange the spacer and clamping unit inside the machine at the respective ideal positions.

BRIEF DESCRIPTION OF THE DRAWING

The invention will now be described in more detail in the following with reference to an example as shown in the drawing. in which.

DESCRIPTION OF PREFERRED EMBODIMENTS

Figure 1:
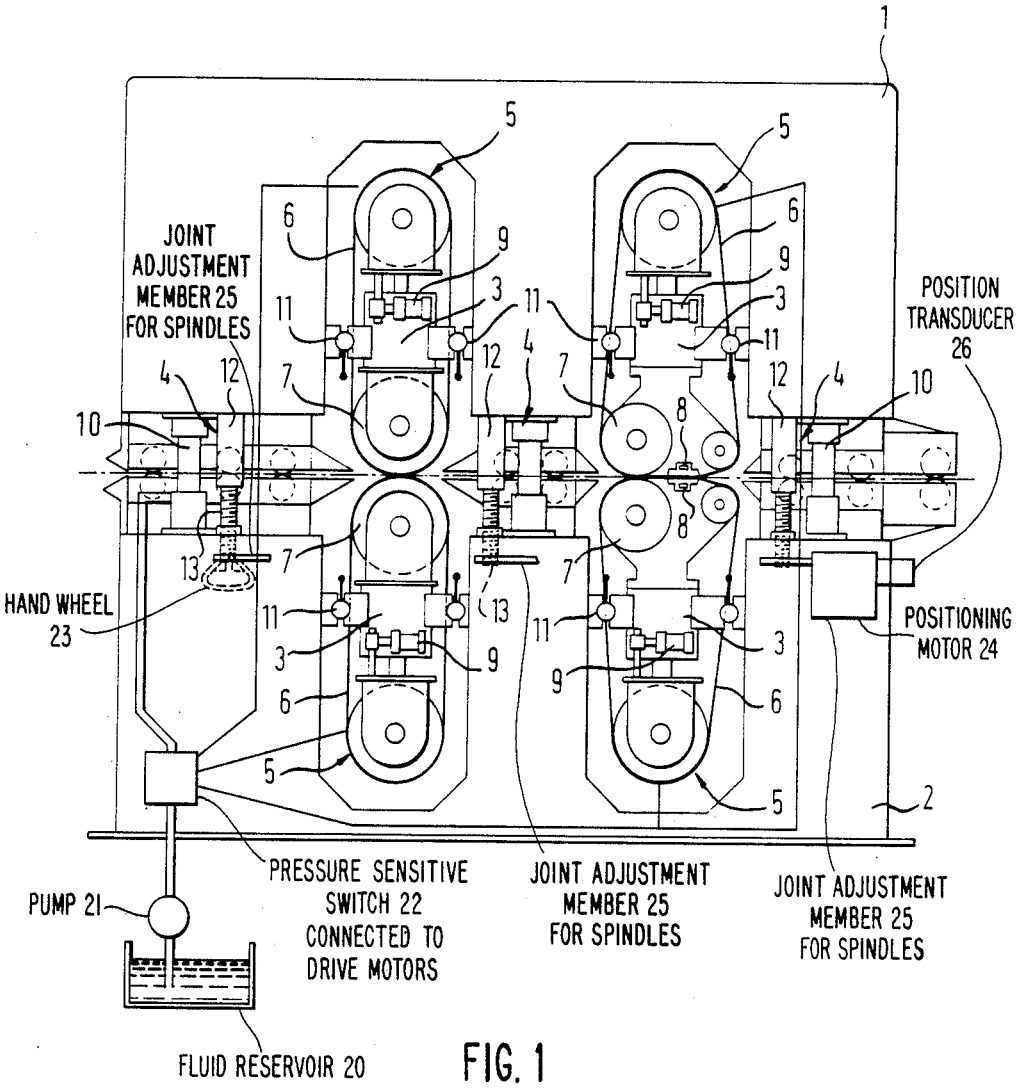
FIG. 1 shows a schematic side view of a belt grinding machine in accordance with the invention.
Figure 2:
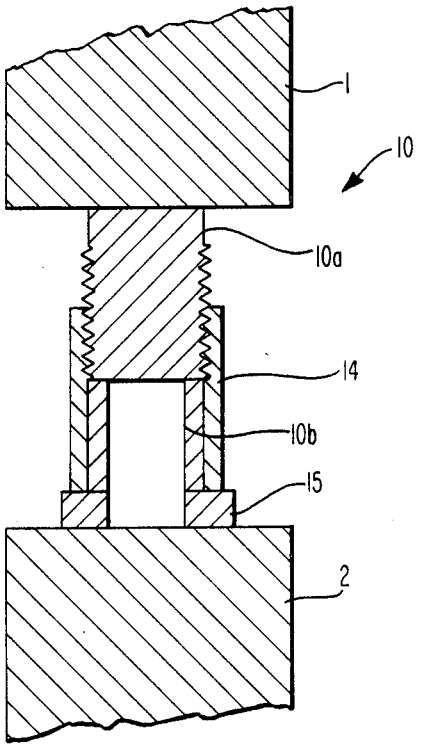
FIG. 2 shows a detail of FIG. 1.

The belt grinding machine embraces an upper housing part 1 and a lower housing part 2 in which oppositely disposed carrier units 3 are secured by means of releasable locks 11. These carrier units 3 are components of belt grinding units 5, which in this embodiment are four in number. As shown in the drawing two belt grinding units are arranged in the upper housing part and two belt grinding units are arranged in the lower housing part, with the belt grinding units in the upper housing part lying opposite to the belt grinding units in the lower housing part. It is however also possible for the belt grinding units in the upper housing part to be displaced relative to the belt grinding units in the lower housing part in the direction of movement of the boards which are to be ground.

Each belt grinding unit 5 includes an endless grinding belt 6 which is guided over a contact roller 7 and optionally over a pressure beam 8. In the illustrated embodiment the counter-pressure element or support element which is required is likewise formed by a contact roller around which the grinding belt moves, or by a contact roller and a pressure beam.

Tensioning rollers are preferably axially pivoted at short time intervals by means of an oscillation cylinder 9 so that lateral belt control is ensured.

Several spacers 4 are provided between the lower housing part 2 and the upper housing part 1 on both sides of the path of movement of the boards through the machine. A clamping device or loading element 10 is associated with each of these spacers 4.

At least the clamping devices 10 disposed at the machine input and output ends are in the form of double-acting piston-in-cylinder units and simultaneously serve as a lifting means for lifting the housing upper part 1 relative to the housing lower part 2. It will be understood that the cylinder of **10*a* each piston-in-cylinder unit is secured at one end to one of the upper and lower housing parts and that the piston 10*b* of this piston-in-cylinder unit is secured to the other of the upper and lower housing parts by an associated piston rod. A support sleeve 14 is threadedly connected to cylinder 10*a* and copperates with an abutment 15 which surrounds piston 10*b*. Working chambers are formed in the cylinder of each piston-in-cylinder unit on both sides of the piston. By introducing pressure fluid into one of the chambers from a reservoir 20, via a pump 21 and a pressure-sensitive switch 22** the piston-in-cylinder unit can be made to extend, thus producing the desired separation between the upper and lower housing parts. By introducing pressure fluid into the other chamber on the other side of the piston the piston-in-cylinder unit will be caused to contract and will draw the upper housing part towards the lower housing part clamping the associated spacer therebetween.

The spacers 4 are steplessly adjustable and consist of a threaded spindle 13 having an actuating member, for example a hand wheel 23, and also a fixed abutment 12. Adjustment can also be made jointly by a motor 24 and adjustment members 25 via a transducer 26. Each threaded spindle 13 is guided in a threaded block provided at the lower part of the housing and engages in a support sleeve 12 which is secured to the upper housing part 1 and which forms the fixed abutment.

The clamping devices formed by the piston-in-cylinder units can be pneumatically or hydraulically loaded with predetermined pressures so that raising, lowering and clamping of the housing upper part 1 relative to the housing lower part 2 can be readily effected by a simple pressure control system. In the clamped state the spacers 4 are clamped between the upper and lower parts of the housing. As a result of the adjustment accuracy of the spacers 4, and of the mutual clamping of the upper part of the housing and the lower part of the housing, which can be predeterminably set in defined manner over the length of the machine it is possible to obtain not only a coarse adjustment of the grinding gap but also the required fine adjustment of the grinding gap via the spacers 4 and the clamping elements 10, so that additional fine adjustment means are not required in the belt grinding units 5.

An important advantage of the cooperation of the accurately adjustable spacers and of the pneumatic or hydraulically actuated piston-in-cylinder units for axial loading of the spacers lies in the fact that the clamping force exerted through the piston-in-cylinder units can be selected in dependence on the prevailing operating conditions. Furthermore, it is also possible to avoid the danger of damage to the belt grinding units originating from sudden thickness fluctuations of the boards which are to be ground, by immediately reducing the fluid pressure as soon as such pronounced thickness fluctuations occur. This makes it possible for the belt grinding units 5 to move out of the way in the vertical direction. In a case such as this the stopping of the belt grinding machine can be controlled or initiated in dependence on the pressure rise in the fluid feeding system. As the pressure rise in the fluid feed system originating from an impermissable deviation in thickness will be noticed before the disturbing thickness deviation reaches the first belt grinding unit, it is possible to ensure that even short term overloading of the belt grinding units is avoided, and thus that any danger of damage is precluded.

In this connection it is of significance that after a part of the machine has moved out of the way in the vertical direction, for example during overloading, it is possible for the machine to be reset to the originally selected final thickness and basic thickness setting without this basic setting having to be corrected. This brings advantages when grinding boards in the customary large series.

It will be appreciated that the particleboards move through the belt guiding machine from the right to the left as seen in the drawing, along the path illustrated in chain dotted lines. The feed of the boards is effected by the cooperating pairs of rollers illustrated in broken lines on either side of the chain dotted path of movement. The machine can of course be used for grinding both individual boards and also continuous lengths of board from a continuous manufacturing plant.

I claim:

1. A belt grinding machine for continuous surface grinding of board having upper and lower surfaces, the machine having first and second longitudinal sides and comprising an upper housing part; a lower housing part; means for continuously feeding the board between said upper housing part and said lower housing part during grinding; fluidic lifting means for lifting said upper housing part relative to said lower housing part for adaptation to different board thicknesses; respective spacers provided at each of said first and second longitudinal sides between said upper housing part and said lower housing part for effecting a basic board thickness selection; at least one belt grinding unit mounted in at least one of said upper and lower housing parts; said at least one belt grinding unit having a respective endless grinding belt and guide means in the form of at least one of a contact roller and a pressure beam for guiding said endless belt over one of said upper lower surfaces; and support means disposed opposite to said guide means and engageable with the other one of said upper and lower surfaces; wherein a respective pressure fluid loaded and vertially steplessly adjustable clamping device is associated with each of said spacers for clamping said upper housing part to said lower housing part via said spacers, thereby defining the ground thickness of said board.

2. A belt grinding machine in accordance with claim 1 wherein said support means comprises one of a second belt grinding unit, and a counter-pressure roller.

3. A belt grinding machine in accordance with claim 1, wherein four of said belt grinding units are provided, with two of said belt grinding units being disposed in said upper housing part for grinding said upper surface, and with the further two belt grinding units being disposed in said lower housing part for grinding said lower surface.

4. A belt grinding machine in accordance with claim 1 wherein at least some of said clamping devices are constructed in the form of double-acting piston-in-cylinder units.

5. A belt grinding machine in accordance with claim 2 and having a machine input end and a machine output end, wherein clamping devices are disposed at said machine input end and at said machine output end, and wherein at least these clamping devices are constructed as double-form acting piston-in-cylinder units and simultaneously form said fluidic lifting means.

6. A belt grinding machine in accordance with claim 1 wherein each said clamping device is arranged directly adjacent the associated spacer.

7. A belt grinding machine in accordance with claim 1 wherein said spacers are steplessly adjustable.

8. A belt grinding machine in accordance with claim 7 wherein each said spacer comprises a threaded spindle and an associated fixed abutment.

9. A belt grinding meachine in accordance with claim 6 wherein a respective threaded block is provided on said housing for each of said threaded spindles, wherein the fixed abutment associated with each of said threaded spindles comprises a support sleeve secured to the other said housing part, with one end of the associated spindle engaging in said support sleeve, and wherein means is provided for rotating each of said threaded spindles.

10. A belt grinding meachine in accordance with claim 9, wherein said means for rotating each of said threaded spindles comprises a hand wheel for each said spindle.

11. A belt grinding machine in accordance with claim 9, wherein said means for rotating each of said spindles comprises a positioning motor.

12. A belt grinding machine in accordance with claim 1, wherein said spacers are coupled together by an actuating mechanism and are jointly adjustable.

13. A belt griding machine in accordance with claim 12, wherein a position transducer is associated with at least one of said spacers.

14. A belt grinding machine in accordance with claim 1, wherein a fluid pressure system having pressure limiting means is connected to said clamping devices.

15. A belt grinding machine in accordance with claim 14, wherein a valve which responds to a regulatable excess pressure is associated with at least one of said clamping devices.

16. A belt grinding machine in accordance with claim 1, wherein each said spacer comprises a steplessly adjustable part, wherein each said clamping device comprises a piston-in-cylinder unit, wherein the cylinder of each piston-in-cylinder unit is connected to one of said housing parts, wherein a support sleeve is threadedly connnected to the cylinder of each piston-in-cylinder unit and wherein said support sleeve cooperates with a fixed abutment which surrounds the piston of the associated piston-in-cylinder unit and which is located on the other one of said housing parts.

17. A belt grinding machine in accordance with claim 1, wherein said spacers and the cooperating clamping devices simultaneously form means for coarse and fine adjustment of the board thickness during grinding.

18. A belt grinding machine in accordance with claim 1, wherein means is provided for stopping said at least one grinding unit in dependence on a pressure rise in said fluid pressure system.

* * * * *